US008356809B2

(12) United States Patent
Dawley et al.

(10) Patent No.: US 8,356,809 B2
(45) Date of Patent: Jan. 22, 2013

(54) ADJUSTABLE DELIVERY WEB CONVERSION APPARATUS AND METHOD

(75) Inventors: Douglas Joseph Dawley, Dover, NH (US); Kent Dirksen Kasper, Dover, NH (US); Daniel Matthew Perdue, Rochester, NH (US); Kyle Albert Sandahl, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/329,810

(22) Filed: Dec. 19, 2011

(65) Prior Publication Data

US 2012/0172187 A1 Jul. 5, 2012

Related U.S. Application Data

(63) Continuation of application No. 13/113,665, filed on May 23, 2011, now Pat. No. 8,104,755, which is a continuation of application No. 12/322,738, filed on Feb. 6, 2009, now Pat. No. 7,963,515.

(51) Int. Cl.
*B41F 13/54* (2006.01)

(52) U.S. Cl. ..... 270/21.1; 270/5.03; 270/52.09; 270/52.12

(58) Field of Classification Search ..... 270/5.02, 270/5.03, 21.1, 52.09, 52.12, 52.17
See application file for complete search history.

(56) References Cited

U.S. PATENT DOCUMENTS 2,019,658 A 11/1935 Crafts
2,361,459 A 10/1944 Corbin
2,395,950 A 3/1946 Wolf
2,613,077 A 10/1952 Smith
2,631,845 A 3/1953 Zuckerman
3,623,722 A 11/1971 Siongren et al.
3,717,249 A 2/1973 Faley
3,889,939 A 6/1975 Faltin
3,915,445 A 10/1975 Duncan et al.
3,948,504 A 4/1976 Woessner et al.
3,964,598 A 6/1976 Alsop
4,026,537 A 5/1977 Harris
4,034,973 A 7/1977 Hams
4,050,686 A 9/1977 McCain et al.
4,279,410 A 7/1981 Bolza-Schunemann
4,466,603 A 8/1984 Schnell
4,533,132 A 8/1985 Wangermann
4,534,552 A 8/1985 Rahe
4,543,863 A * 10/1985 Rader ..... 83/76
4,545,782 A 10/1985 Niemiro et al.

(Continued)

OTHER PUBLICATIONS

U.S.P.T.O. Office Action in U.S. Appl. No. 12/322,775 (Pub. 2010/0201056) dated Dec. 28, 2010.

(Continued)

*Primary Examiner* — Patrick Mackey
(74) *Attorney, Agent, or Firm* — Davidson, Davidson & Kappel, LLC

(57) ABSTRACT

An adjustable delivery web conversion apparatus is provided. The adjustable delivery web conversion apparatus includes a variable cutting apparatus cutting a printed web into a first signature and a second signature, a first assembly receiving the first signature and a second assembly downstream of the first assembly receiving the second signature. Also included are a first delivery section for receiving the first signature from the first assembly, a second delivery section for receiving the second signature from the second assembly and a stack receiving conveyor for receiving the first signature and the second signature. The first delivery section is movable between a first delivery and a first non-delivery position. The second delivery section is movable between a second delivery position and a second non-delivery position. The stacking receiving conveyor is movable between a conveying position and a non-conveying position. A method of producing and delivering signatures is also provided.

9 Claims, 7 Drawing Sheets

U.S. PATENT DOCUMENTS

| | | | | |
|---|---|---|---|---|
| 4,593,893 | A | 6/1986 | Suter | |
| 4,729,282 | A | 3/1988 | Kasdorf | |
| 4,919,027 | A | 4/1990 | Littleton | |
| 5,014,975 | A | 5/1991 | Hamricke | |
| 5,080,338 | A | 1/1992 | Belanger et al. | |
| 5,098,075 | A | 3/1992 | Lindblom | |
| 5,176,371 | A | 1/1993 | Rau et al. | |
| 5,293,797 | A | 3/1994 | Spalding et al. | |
| 5,346,195 | A * | 9/1994 | Heimann et al. | 270/52.01 |
| 5,354,047 | A | 10/1994 | Chesnutt et al. | |
| 5,405,127 | A | 4/1995 | Welborn | |
| 5,439,206 | A | 8/1995 | Raasch et al. | |
| 5,522,586 | A | 6/1996 | Bennett et al. | |
| 5,538,242 | A | 7/1996 | Doucet | |
| 5,542,547 | A | 8/1996 | Ricciardi | |
| 5,707,054 | A | 1/1998 | Loquet et al. | |
| 6,062,372 | A | 5/2000 | Cote et al. | |
| 6,231,044 | B1 | 5/2001 | Neary et al. | |
| 6,341,773 | B1 | 1/2002 | Aprato et al. | |
| 6,360,640 | B1 | 3/2002 | Cote | |
| 6,364,305 | B1 * | 4/2002 | Sussmeier et al. | 270/52.09 |
| 6,439,562 | B1 | 8/2002 | Cote et al. | |
| 6,443,449 | B1 | 9/2002 | Takagi et al. | |
| 6,572,097 | B2 | 6/2003 | d'Agrella et al. | |
| 6,588,739 | B1 | 7/2003 | Weis | |
| 6,684,746 | B2 | 2/2004 | Hilliard et al. | |
| 7,621,857 | B2 | 11/2009 | Pompile | |
| 7,913,989 | B2 * | 3/2011 | Sandahl et al. | 270/52.17 |
| 7,918,443 | B2 * | 4/2011 | Fokos | 270/52.19 |
| 2001/0022421 | A1 | 9/2001 | Schaefer et al. | |
| 2004/0060464 | A1 | 4/2004 | Birkenfeld et al. | |
| 2004/0135303 | A1 | 7/2004 | Weiler | |
| 2005/0124481 | A1 | 6/2005 | d'Agrella et al. | |
| 2006/0144507 | A1 | 7/2006 | Herbert et al. | |
| 2006/0180438 | A1 | 8/2006 | Mosli et al. | |
| 2007/0062392 | A1 | 3/2007 | Ratz | |
| 2007/0068408 | A1 | 3/2007 | Christmann et al. | |
| 2008/0112743 | A1 | 5/2008 | Moore | |
| 2008/0128983 | A1 | 6/2008 | Prim et al. | |
| 2008/0190309 | A1 | 8/2008 | Rancourt et al. | |
| 2009/0127763 | A1 | 5/2009 | Cossette | |
| 2010/0201056 | A1 | 8/2010 | Dawley | |
| 2010/0201058 | A1 | 8/2010 | Dawley et al. | |
| 2010/0201065 | A1 | 8/2010 | Dawley et al. | |
| 2010/0201066 | A1 | 8/2010 | Dawley | |

OTHER PUBLICATIONS

U.S.P.T.O. Office Action in U.S. Appl. No. 12/322,767 (Pub. 2010/0201058) dated Sep. 14, 2010.

U.S.P.T.O. Office Action in U.S. Appl. No. 12/322,738 (Pub. 2010/0201065) dated Sep. 15, 2010.

U.S.P.T.O. Office Action in U.S. Appl. No. 12/322,768 (Pub. 2010/0201066) dated Sep. 15, 2010.

U.S.P.T.O. Office Action in U.S. Appl. No. 12/322,775 (Pub. 2010/0201056) dated Mar. 22, 2011.

Vits-Multicut HP Servo Drive Sheeter; http://www.vits.com/index_en.php?level=3&CatID=3.13.16.49&inhalt_id=47 (accessed Feb. 4, 2009).

Vits Rotocut S; http://www.vits.com/index_en.php?level=3&CatID-3.13.16.49&inhalt_id=43 (accessed Feb. 4, 2009).

Vits Rotocut HS; http://www.vits.com/index_en.php?level=3&CatID=3.13.16.49&inhalt_id=44# (accessed Feb. 4, 2009).

Innotech High Speed Sheeters; http://www.innotechequip.com/sheeter htm (accessed Feb. 4, 2009).

Innotech Finishing Line Equipment; http://www.innotechequip.com/finishing.htm (accessed Feb. 4, 2009).

Goss International; M-600 Folia: High Productivity Perfecting Press; 2008 (accessed from http://www.gossinternational.com/clientuploads/folia/downloads.htm, on Feb. 5, 2009).

Goss International; M-600: 16-Page Web Offset Press Systems; Aug. 5, 2008 (accessed from http://gossinternational.com/index.php?src=gendocs&ref=m600&category=en_Products, on Feb. 5, 2009).

Manroland; Roland 900: Printing Units, Dimensions and Details; http://www.manroland.com/com/pdf_en/MR_ROLAND_900_Datenblatt_e.pdf (accessed Feb. 5, 2009).

Manroland; Nothing Can Replace Capacity: The Roland 900; http://www.manroland.com/com/pdf_en/MR_ROLAND_900_Broschuere_e.pdf (accessed Feb. 5, 2009).

* cited by examiner

ADJUSTABLE DELIVERY WEB CONVERSION APPARATUS AND METHOD

This is a continuation of U.S. application Ser. No. 13/113,665 filed May 23, 2011, which is a continuation of U.S. application Ser. No. 12/322,738 filed Feb. 6, 2009, both of which are hereby incorporated by reference herein.

The present invention relates generally to printing presses and more particularly to adjustable delivery web conversion apparatuses and methods in printing presses.

BACKGROUND OF INVENTION

Combination folders are currently available that can deliver relatively high page-count products (typically 32- or 64-page) and a former-folder-style product (slit over former and half-folded). These combination folders are typically complex and expensive and have fixed cut-offs. Conventional folders may be limited to delivering either straight products or collated products.

U.S. Pat. No. 4,533,132 discloses a collating and stitching machine to arrange into informative and significant order a plurality of part-product or sheets. The machine has at least two rotating sheet delivery drums, the axis of rotation of which extend substantially perpendicularly to the conveying direction of an endless conveyor. The endless conveyor transports the folded sheets during the collating thereof with their folded backs extending transversely to the conveying direction and with the folded backs leading the direction of movement. The conveyor inserts the sheets one into the other. At least one stitching head is arranged in the return area to the endless conveyor to stitch the sheets together and thereby form a booklet, a magazine or the like.

U.S. Pat. No. 5,538,242 discloses a folder apparatus for a web-fed printing press. The printed webs are conducted over a former and folded. After being folded, the web is fed through the nips of upper and lower draw rollers and guide rollers to a cutting cylinder, which severs the web to form printed signatures. A web separating device is provided between the upper draw rollers and the lower draw rollers. The signatures are then fed by a lead-in tape system to fan pockets of two fans. As the fans rotate, the signatures are deposited to two stacks.

U.S. Pat. No. 6,231,044 discloses a delivery portion of a folder of a high speed printing press which includes a diverting section and a bucket section. Successive folded and cut signatures enter the diverting section from the cutting cylinders and are positioned between driven transport tapes. The signatures are diverted into a first or a second signature path and, most typically, the signatures are diverted alternately to the first path then to the second path. After being diverted, the signatures enter the bucket section of the folder. Signatures on the first path are transported between the tapes to a first rotating bucket assembly and the signatures on the path are transported between the tapes to a second rotating bucket assembly. The first bucket assembly transfers and slows down signatures diverted along the first path to a first conveyor and the second bucket assembly transfers signatures diverted along the second path to a second conveyor. The conveyors transport the signatures in a shingled stream to an area for accumulation or further processing, such as to a stacker.

BRIEF SUMMARY OF THE INVENTION

An adjustable delivery web conversion apparatus is provided. The adjustable delivery web conversion apparatus includes a variable cutting apparatus cutting a printed web into a first signature and a second signature, a first assembly receiving the first signature and a second assembly downstream of the first assembly receiving the second signature. Also included are a first delivery section for receiving the first signature from the first assembly, a second delivery section for receiving the second signature from the second assembly and a stack receiving conveyor for receiving the first signature and the second signature. The first signature is stacked on the second signature on the stack receiving conveyor. The first delivery section is movable between a first delivery position where the first delivery section can receive the first signature from the first assembly and a first non-delivery position where the first delivery section cannot receive the first signature. The second delivery section is movable between a second delivery position where the second delivery section can receive the second signature from the second assembly and a second non-delivery position where the second delivery section cannot receive the second signature. The stacking receiving conveyor is movable between a conveying position where the stacking receiving conveyor can receive the first signature from first assembly and the second signature from the second assembly and a non-conveying position where the stacking receiving conveyor cannot receive the first signature or the second signature.

A method of producing and delivering signatures is provided. The method includes the steps of cutting a printed web with a cutting apparatus to create a first print job first signature and a first print job second signature; transporting the first print job first signature to a first assembly; transporting the first print job second signature to a second assembly; delivering the first print job first signature and the first print job second signature to a stack receiving conveyor such that the first print job first signature is stacked upon the first print job second signature; moving the stack receiving conveyor to a non-conveying position where the stack receiving conveyor cannot receive signatures from the first assembly and second assembly; moving a first delivery into a first delivery position; cutting a printed web with a cutting apparatus to create a second print job first signature; transporting the second print job first signature to the first assembly; delivering the second print job first signature to the first delivery.

BRIEF DESCRIPTION OF THE DRAWINGS

The present invention is described below by reference to the following drawings, in which.

DETAILED DESCRIPTION

Figure 1:
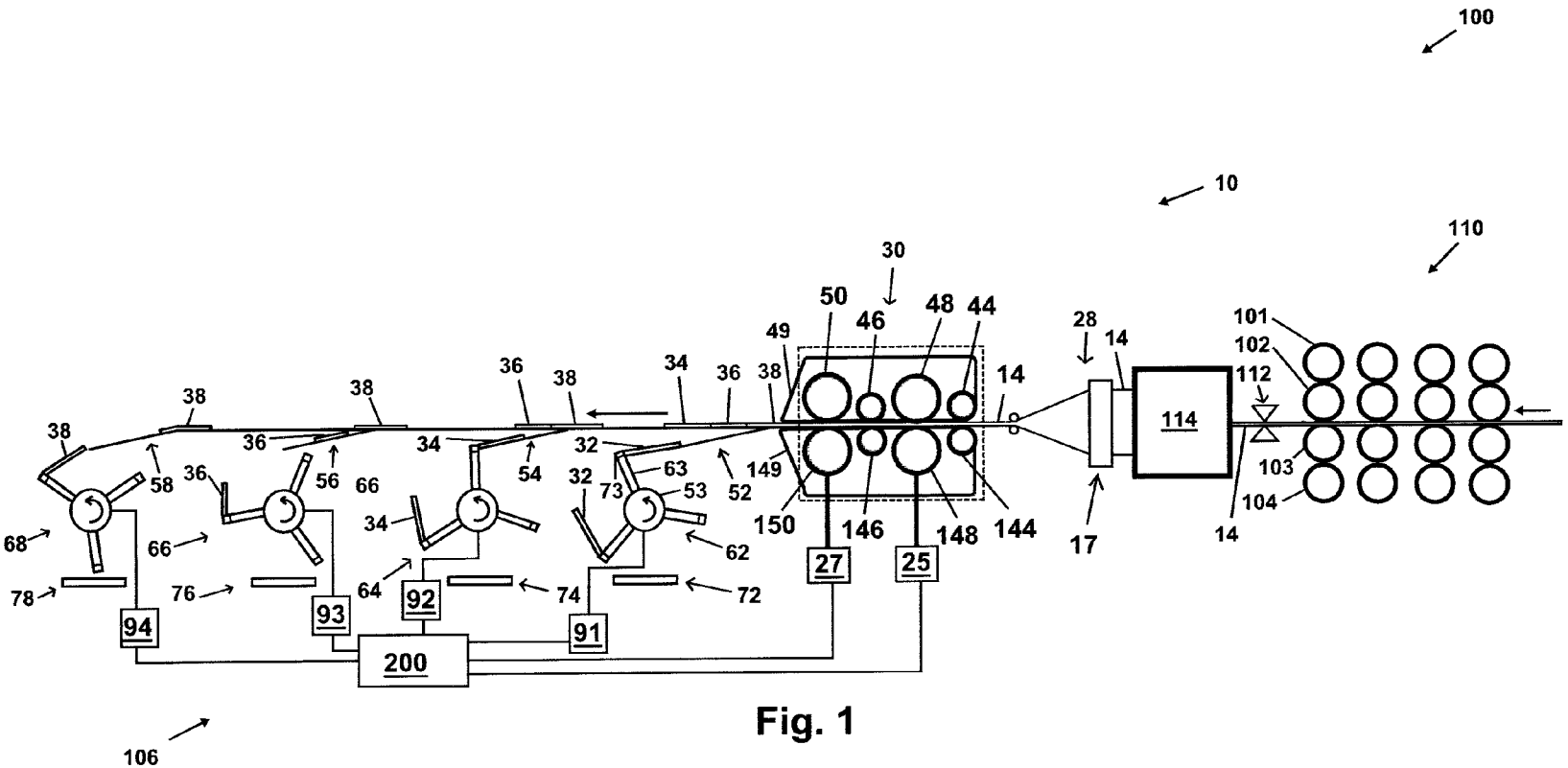
FIG. 1 shows a schematic side view of a printing press including an adjustable delivery web-conversion apparatus according to an embodiment of the present invention configured for straight delivery.

FIG. 1 shows a schematic side view of a printing press 100 including an adjustable delivery web conversion apparatus 10 according to an embodiment of the present invention configured for straight delivery. Printing units 110, each including an upper plate cylinder 101, an upper blanket cylinder 102, a lower blanket cylinder 103 and a lower plate cylinder 104, act together to print four color images on a web 12. The term image used herein includes text, graphics or printed indicia on web 12, with each image have a length equal to a circumferential printing length of each plate cylinder 101, 104 and including contents of a number of pages of final printed products produced by printing press 100. After images are printed on web 12, web 12 passes through a slitter 112, which longitudinally slits web 12 into a plurality of ribbons 14. A ribbon guiding section 114 may then turn and offset ribbons 14 so ribbons 14 are vertically aligned and traveling in a horizontal plane as ribbons 14 pass through vertically aligned nip rolls 17 and enter a former 28. Former 28 imparts a longitudinal fold upon ribbons 14 such that ribbons 14 are horizontally aligned and traveling substantially in the same horizontal plane as ribbons exit former 28. Ribbons 14 may also be slit over former 28 to yield twice as many unfolded ribbons 14. Web 12 and ribbons 14 may travel at a velocity V1.

Once longitudinally folded, ribbons 14 are cut by a cutting assembly 30 into successive intermediate printed products or signatures 32, 34, 36, 38. Cutting assembly 30 includes cut cylinders 48, 50 interacting with respective anvil cylinders 148, 150 to create signatures 32, 34, 36, 38. Cut cylinder 48 may include one or more knives that are segmented and partially cut, or perforate, ribbons 14 by contacting anvils on anvil cylinder 148. Cut cylinder 50 may include knives that finish the partial cuts created by knives of cut cylinder 48, forming signatures 32, 34, 36, 38, by contacting anvils on anvil cylinder 150. Knives on cut cylinder 50 may also be segmented. Cutting assembly 30 may include a first pair of nip rollers 44, 144, and a second pair of nip rollers 46, 146. Nip rollers 44, 144, 46, 146 deliver ribbons 14 to cut cylinder 48 where knife blades perforate ribbons 42 with a first cut. The process of partially cutting ribbons with cut cylinder 48 and finishing the cut with cut cylinder 50 may be referred to as a double cut. In another embodiment, ribbons 14 may also be cut completely by cut cylinder 50 and anvil cylinder 150, making the perforation by cut cylinder 48 and anvil cylinder 148 unnecessary.

In this embodiment, printing units 110 print successive four-color images on both sides of web 12, each image being aligned with an image on the opposite side of web 12. Each image includes the contents of 32 pages of final printed products produced from the image, so that a length of web 12 with an image on both sides includes the contents of 64 pages of the final printed products. Cutting assembly 40 forms four individual signatures 32, 34, 36, 38 from each image printed on web 12 by printing units 110, with each signature including 16 pages (8 pages, printed on both front and back). For example, ribbons 14 are cut by cutting assembly 30 such that one cut by cut cylinder 50 creates a lead edge of one first signature 32, a subsequent by cut cylinder 50 creates a lead edge of one second signature 34 and a tail edge of the one first signature 32, a subsequent by cut cylinder 50 creates a lead edge of one third signature 36 and a tail edge of the one second signature 34, a subsequent by cut cylinder 50 creates a lead edge of one fourth signature 38 and a tail edge of the one third signature 36 and a subsequent by cut cylinder 50 creates a lead edge of one subsequent first signature 32 and a tail edge of the one fourth signature 38. In the embodiment where a double cut is performed, each cut by cut cylinder 50 creating edges of signatures finishes a partial cut created by cut cylinder 48. In the embodiment where only cut cylinder 50 is provided, and not cut cylinder 48, each cut by cut cylinder 50 cuts entirely through ribbons 14.

Cylinders 48, 148 may be phased with respect to cylinders 50, 150, with cylinders 48, 148 being driven by a servomotor 25 at varying velocities during each revolution and cylinders 50, 150 being driven by a servomotor 27 at varying velocities during each revolution so that printed signatures 32, 34, 36, 38 may vary in length. Servomotors 25, 27 may be controlled by a controller 200. Any combination of cutoff lengths for signatures 32, 34, 36, 38 is possible, as long as the sum of the cutoff lengths equal the length of each four-color image printed by printing units 110. For example, if plate cylinders 101, 104 and blanket cylinders 102, 103 each have a printing circumference of 44 inches and print images that are 44 inches in length on web 12, signature 32 may have a cutoff length of 15 inches, signature 34 may have a cutoff length of 10 inches, signature 36 may have a cutoff length of 11 inches and signature 38 may have a cutoff length of 8 inches.

Signatures 32, 34, 36, 38, traveling away from cutting assembly 30 enter a delivery section 106 where conveyor 40 transports signatures 32, 34, 36, 38 at a second velocity V2 away from cutting assembly 30. Velocity V2 may be greater than velocity V1. Conveyor 40 may be in the form of transport tapes, which grip a lead edge of ribbons 13 just as ribbons 14 are cut by cut cylinder 50 and positively grip signatures 32, 34, 36, 38 by contacting signatures 32, 34, 36, 38 from above and below. Guide belts 49, 149 may be provided to assist in guiding ribbons 14 into cutting assembly and signatures 32, 34, 36, 38 towards conveyor 40. Guide belts 49, 149 may be provided in circumferential cutouts spaced axially in cylinders 48, 50, 148, 150 and rolls 44, 46, 144, 146. In an alternative embodiment, guide belts 49, 149 may be introduced only between cut cylinder 48 and cut cylinder 50 to control the printed product while the uncut portions of ribbons 14 are cut by cut cylinder 50.

Signatures 32, 34, 36, 38 are diverted from conveyor 40 by respective diverter assemblies 52, 54, 56, 58. Diverter assemblies 52, 54, 56, 58 force respective signatures 32, 34, 36, 38 out of the path of conveyor 40 and down to respective deceleration assemblies 62, 64, 66, 68.

A first diverter assembly 52 removes signatures 32 from conveyor 40 and transports signatures 32 to a first deceleration assembly 62. First deceleration assembly 62, rotating about a first axis that is perpendicular to the direction of travel of conveyor 40, grips signatures 32 and delivers signatures 32 to first delivery section 72. First delivery section 72, which may be a conveyor running axially with respect to deceleration assembly 62 in a second horizontal plane below the horizontal plane of conveyor 40, carries signatures 32 away from deceleration assembly 62.

Signatures 34, 36, 38 are transported by conveyor 40 past first diverter assembly 52. A second diverter assembly 54 removes signatures 34 from conveyor 40 and transports signatures 34 to a second deceleration assembly 64. Second deceleration assembly 64, rotating about a second axis that is perpendicular to the direction of travel of conveyor 40, grips signatures 34 and delivers signatures 34 to second delivery section 74. Second delivery section 74, which may be a conveyor running axially with respect to deceleration assembly 64 in the second horizontal plane below the horizontal plane of conveyor 40, carries signatures 34 away from deceleration assembly 64.

Signatures 36, 38 are transported by conveyor 40 past second diverter assembly 54. A third diverter assembly 56 removes signatures 36 from conveyor 40 and transports signatures 36 to a third deceleration assembly 66. Third deceleration assembly 66, rotating about a third axis that is perpendicular to the direction of travel of conveyor 40, grips signatures 36 and delivers signatures 36 to third delivery section 76. Third delivery section 76, which may be a conveyor running axially with respect to deceleration assembly 66 in the second horizontal plane below the horizontal plane of conveyor 40, carries signatures 36 away from deceleration assembly 66.

Signatures 38 are transported by conveyor 40 past third diverter assembly 56. A fourth diverter assembly 58 removes signatures 38 from conveyor 40 and transports signatures 38 to a fourth deceleration assembly 68. Fourth deceleration assembly 68, rotating about a fourth axis that is perpendicular to the direction of travel of conveyor 40, grips signatures 38 and delivers signatures 38 to fourth delivery section 78. Fourth delivery section 78, which may be a conveyor running axially with respect to deceleration assembly 68 in the second horizontal plane below the horizontal plane of conveyor 40, carries signatures 38 away from deceleration assembly 68. In an alternative embodiment, fourth diverter assembly 58 is not necessary, and conveyor 40 may transport signatures 38 directly to fourth deceleration assembly 68.

Signatures 32, 34, 36, 38 may be transported by respective delivery sections 72, 74, 76, 78 at a velocity V3, which may be less than velocity V2, to downstream finishing operations.

Each deceleration assembly 62, 64, 66, 68 may include a center body 53, arms 63, and grippers 73, respectively. Arms 63 protrude radially from center bodies 53 and grippers 73, which are configured to engage signatures 32, 34, 36, 38, are positioned at ends of arms 63.

Diverting assemblies 52, 54, 56, 58 and deceleration assemblies 62, 64, 66, 68 are phased so that diverting assemblies remove respective signatures 32, 34, 36, 38 from conveyor 40 in a proper orientation and arms 63 of deceleration assemblies 62, 64, 66, 68 are in proper positions to receives signatures 32, 34, 36, 38 from diverting assemblies 52, 54, 56, 58, respectively. Deceleration assemblies 62, 64, 66, 68 may driven by respective motors 91, 92, 93, 94, and diverting assemblies 52, 54, 56, 58 may be driven by respective motors. Motors 91, 92, 93, 94 and the motors driving diverting assemblies 52, 54, 56, 58 may be servomotors and may be controlled by controller 200 to ensure proper phasing.

In alternative embodiments, cutting assembly 30 may be configured to cut each image into a different number of signatures, for example three. The number of diverting assemblies, deceleration assemblies and delivery sections may be adjusted to match the maximum number of signatures produced by cutting assembly 30. Web conversion apparatus 10 may be adjusted to accommodate three signatures from one image by inactivating diverting assembly 58 and deceleration assembly 68 and rephrasing diverting assemblies 52, 54, 56 and deceleration assemblies 62, 64, 66.

In other embodiments, web conversion and delivery apparatus 10 may be configured such that web 12 is not slit into ribbons 14 and/or web 12 is not folded longitudinally by former 28. The term web as used herein is defined such that web may also include ribbons.

Figure 2:
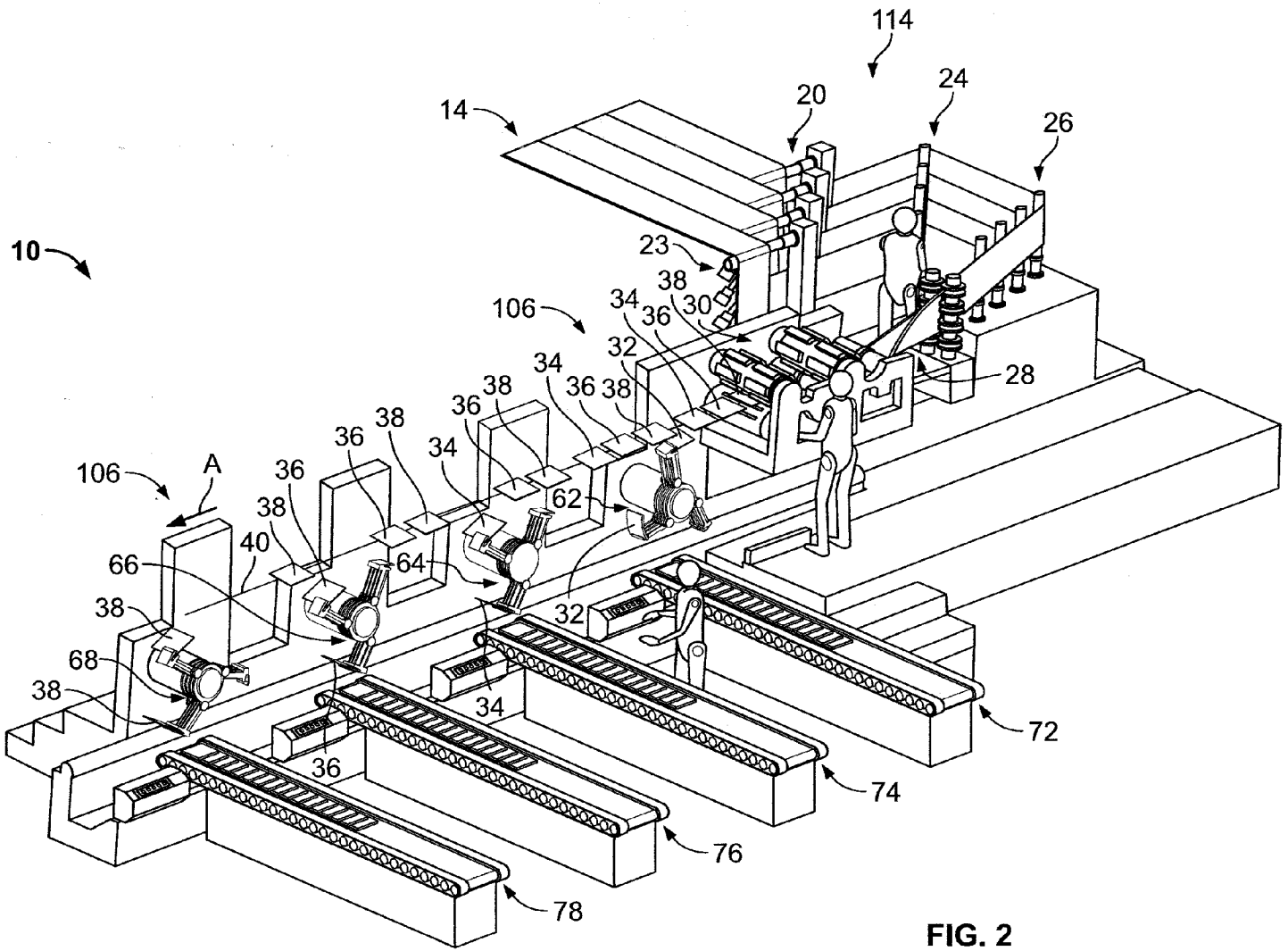
FIG. 2 shows a perspective view of the web conversion apparatus shown in FIG. 1 configured for straight delivery.

FIG. 2 shows a perspective view of web conversion section 10 configured for straight delivery, as shown in FIG. 1. Web conversion apparatus 10 includes ribbon guiding section 114, cutting assembly 30, former 28 and delivery section 106. Ribbons 14 enter web-conversion apparatus 10 and are converted into multiple signatures 32, 34, 36, 38, which may each form individual final printed products.

Figure 5:
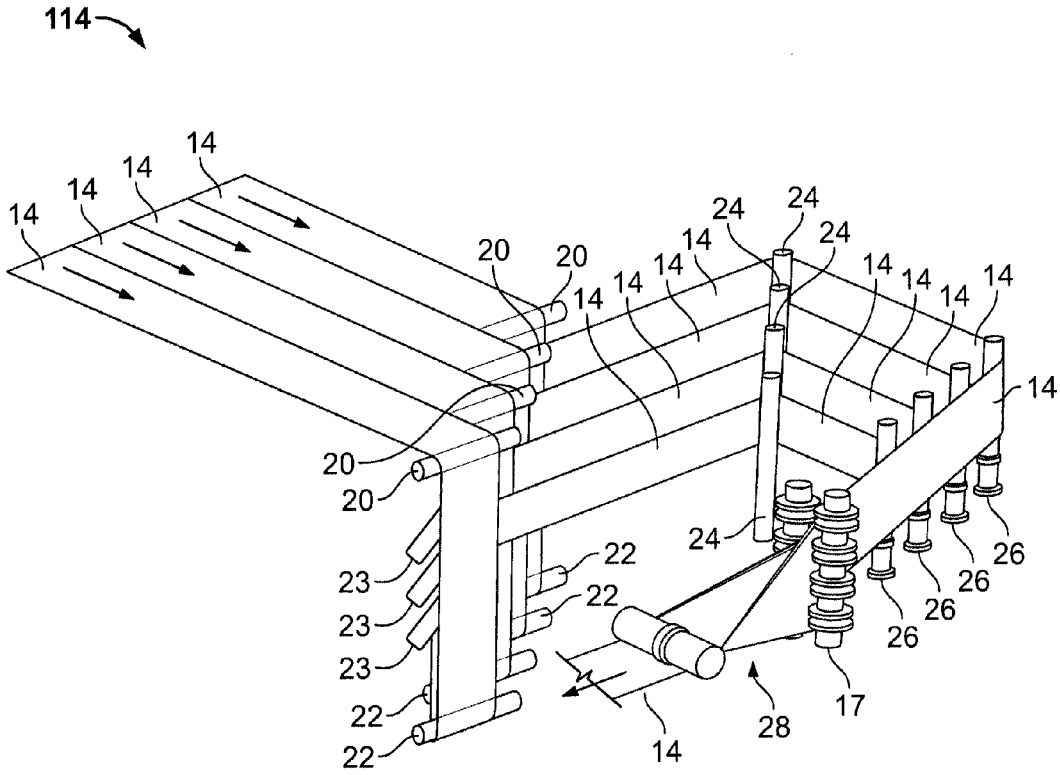
FIG. 5 shows an enlarged perspective view of a ribbon guiding section of the web-conversion apparatus shown in FIGS. 1 to 4.

Ribbon guiding section 114, which is shown in more detail in FIG. 5, includes lead rolls 20, 24, compensators 22 (FIG. 5), angle bars 23 and pull rolls 26. Ribbons 14 are wrapped around and redirected by lead rolls 20, 24 compensators 22, angle bars 23 and pull rolls 26 to ensure ribbons 14 are properly oriented as they enter former 28. Ribbons 14 enter ribbon guiding section 114 traveling substantially horizontal and are guided vertically by lead rolls 20 and compensators 22. Angle bars 23 redirect ribbons 14 so that ribbons 14 are transported horizontally, in an upright on-edge orientation, where each ribbon 14 has one edge located above the other. Lead rolls 24 and pull rolls 26 reverse the horizontal direction of travel of ribbons 14, while maintaining the upright on-edge orientation of ribbons 14. The axes of rotation of lead rolls 24, pull rolls 26, and nip rolls 17 are aligned with the vertical direction, allowing ribbons 14 to transported horizontally into former 28. Ribbons 14 are merged on-edge after pull rolls 26. Ribbons 14 pass between nip rolls 17 and are longitudinally folded by former 28.

Ribbons 14, once longitudinally folded, are aligned with the horizontal direction so that ribbons 14 are no longer oriented on-edge but instead are aligned substantially in the horizontal plane. Ribbons 14 are then cut by a cutting assembly 30 into four successive signatures 32, 34, 36, 38. Cylinders 48, 50, 148, 150 of cutting assembly 30 are rotated at appropriate frequencies so that knives on cut cylinders 48, 50 create signatures 32, 34, 36, 38 having desired lengths. Signatures 32, 34, 36, 38, having a horizontal orientation, are transported in the horizontal direction to respective diverting assemblies 52, 54, 56, 58, which alter the path of signatures and pass signatures 32, 34, 36, 38 to respective deceleration assemblies 62, 64, 66, 68, located below conveyor 40. Deceleration assemblies 62, 64, 66, 68, rotating about axes that are perpendicular to the horizontal direction that conveyor 40 transports signatures 32, 34, 36, 38, grip respective signatures 32, 34, 36, 38, and rotate signatures 32, 34, 36, 38 approximately 180 degrees with respect to the axes of deceleration assemblies 62, 64, 66, 68, respectively. Deceleration assemblies 62, 64, 66, 68 then release signatures 32, 34, 36, 38, now traveling in a direction opposite the transport direction of conveyor 40, to respective delivery sections 72, 74, 76, 78, which may carry signatures 32, 34, 36, 38 away from respective deceleration assemblies 62, 64, 66, 68 in a direction that is parallel to axes of respective deceleration assemblies 62, 64, 66, 68.

The present invention can be appreciated as delivering multiple cut-offs on multiple deliveries in the straight delivery mode. A single group of ribbons may be converted into multiple printed products. For example, a strip of ribbons corresponding to the once-around circumferential printing length of each of the plate cylinders of the printing press may be converted in four different print products of four different lengths. Also, not all deceleration assemblies and delivery assemblies need to be active at the same time, so two printed products could be delivered by two deceleration and two delivery assemblies and two deceleration and two delivery assemblies could be inactive.

By transporting ribbons 14, and signatures 32, 34, 36, 38 primarily in the horizontal direction, the height of web conversion and delivery apparatus 10 is advantageously reduced. The reduced height may lower the ceiling height requirements of printing press facilities and decrease the need for press personnel to climb stairs to reach the various apparatus components. Since web conversion and delivery apparatus 10 can be operated from one level, web conversion and delivery apparatus 10 may thus be easier to operate. In one embodiment, e.g. as shown in FIGS. 1 and 2, web conversion and delivery apparatus 10 may be 38 feet long and 8 feet high. In another embodiment, a web conversion and delivery apparatus may be 54 feet long and 8 feet high and receive eight ribbons and create and deliver six different signatures.

In other embodiments, a second web may be printed by a second set of printing units, slit into ribbons by a second slitter and combined with ribbons 14 to create a ribbon bundle with an increased number of ribbons, which may be converted into signatures with an increased number of pages. Also, more or less than four ribbons 14 could be created by slitter 112 (FIG. 1) and delivered by ribbon guiding section 114. Delivery sections 72, 74, 76, 78 may include grippers or other mechanisms to maintain positive control over signatures 32, 34, 36, 38 and ensure accurate delivery streams.

Figure 3:
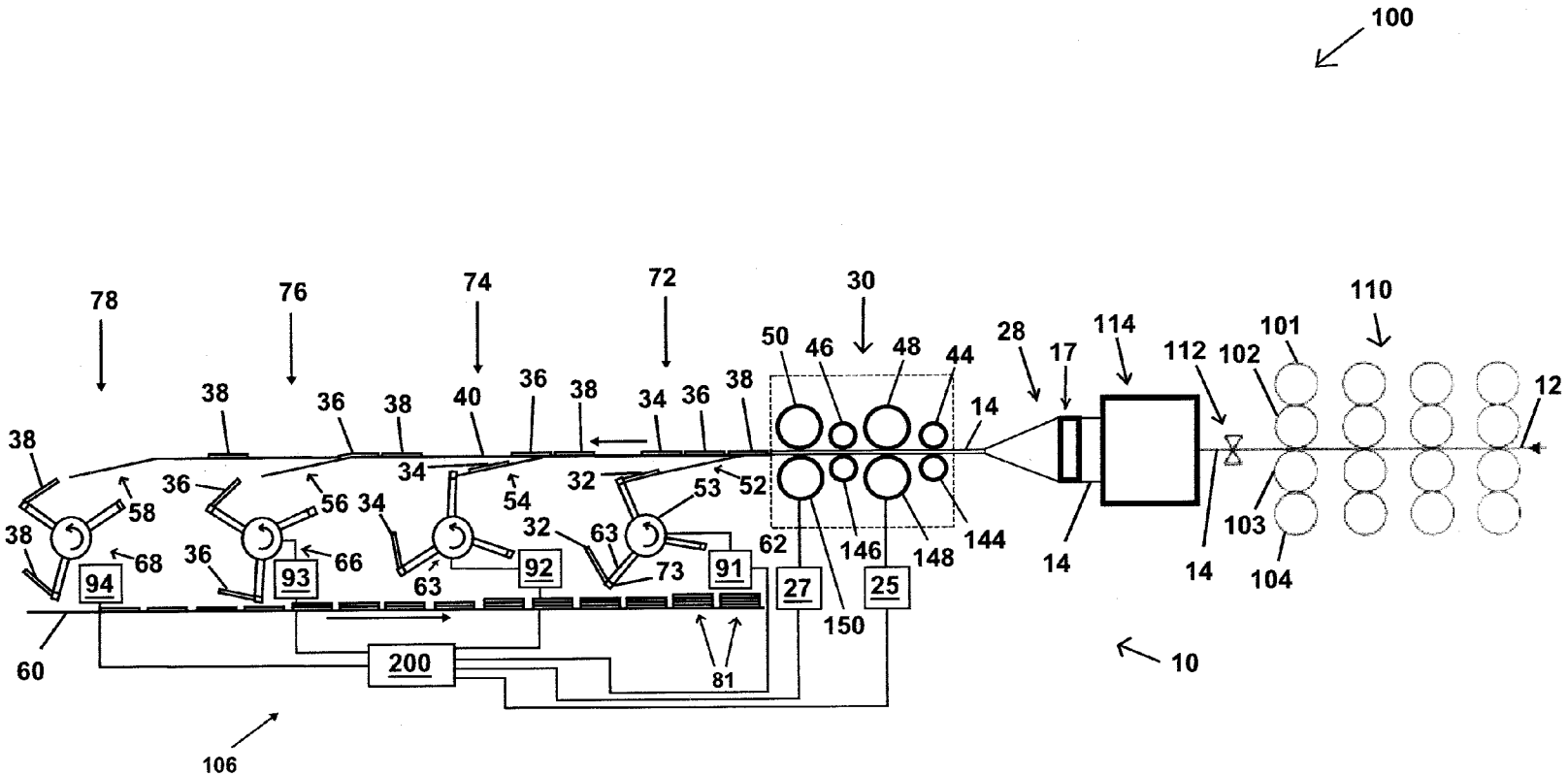
FIG. 3 shows a schematic side view of the printing press shown in FIG. 1 with the adjustable delivery web conversion apparatus configured for collating delivery.

FIG. 3 shows a schematic side view of printing press 100 including adjustable delivery web conversion apparatus 10 configured for collating delivery. Deceleration assemblies 62, 64, 66, 68 stack respective signatures 42, 44, 46, 48 on a conveyor 60 instead of passing signatures 32, 34, 36, 38 to respective delivery sections 72, 74, 76, 78, as in the straight delivery mode.

Printing units 110 print four color images on web 12 and web 12 is slit into ribbons 14. Ribbons 14 are aligned vertically and merged by ribbon guiding section 114 and longitudinally folded by former 28. Web 12 and ribbons 14 may be traveling at a velocity V4.

In this embodiment, printing units 110 print successive four-color images on both sides of web 12, each image being aligned with an image on the opposite side of web 12. Each image includes the contents of 32 pages of final printed products produced from the image, so that a length of web 12 with an image on both sides includes the contents of 64 pages of final printed products.

Once longitudinally folded, ribbons 14 are cut by a cutting assembly 30 into successive signatures 42, 44, 46, 48, with each signature 42, 44, 46, 48 being the same length. Controller 200 controls servomotors 25, 27 so that cut cylinders 48, 50 form four individual signatures 42, 44, 46, 48 from each image printed on web 12 by printing units 110, with each signature including 16 pages (8 pages, printed on both front and back). Signatures are then stacked on conveyor 60 to form final product stacks 81 that consist of 64 pages, which may then be bound, and subject to other finishing operations, to form final printed products.

After being created by cutting assembly 30, signatures 42, 44, 46, 48 then enter web conversion and delivery section 106, which is configured for collating, where conveyor 40 transports signatures 42, 44, 46, 48 at a second velocity V5 away from cutting assembly 30. Velocity V5 may be greater than velocity V4. Signatures 42, 44, 46, 48 are diverted from conveyor 40 by respective diverter assemblies 52, 54, 56, 58 and passed to respective deceleration assemblies 62, 64, 66, 68 in the same manner as signatures 32, 34, 36, 38 (FIG. 1) are in the straight collect configuration.

Fourth deceleration assembly 68, rotating about an axis that is perpendicular to the direction of travel of conveyor 40, enter a collating and delivery section 106, receives each signature 48 one-by-one and passes signatures 48 to a collating conveyor 60. Collating conveyor 60 is traveling at a velocity V3, which may be less than velocity V2, in a second horizontal plane below the horizontal plane of conveyor 40. Collating conveyor 60, in this embodiment, is traveling below deceleration assemblies 62, 64, 66, 68 in a horizontal direction that is opposite the horizontal direction that conveyor 40 transports signatures 42, 44, 46, 48, and is tangential to the paths of rotation of deceleration assemblies 62, 64, 66, 68. Third deceleration assembly 66, operating in a manner similar to fourth deceleration assembly 68, receives signatures 46 one-by-one and places each signature 46 on top of one signature 48 on conveyor 60. Second deceleration assembly 64, operating in a manner similar to deceleration assemblies 66, 68, receives signatures 44 one-by-one and places each signature 44 on top of one signature 46, which is stacked on one signature 48, on conveyor 60. First deceleration assembly 62, operating in a manner similar to deceleration assemblies 64, 66, 68, receives signatures 42 one-by-one and places each signature 42 on top of one signature 44, which is stacked on one signatures 46 and one signature 48, on conveyor 60.

Once signature 42 is stacked upon signatures 44, 46, 48, a final product stack 81 is formed. Final product stack 81 is delivered by conveyor 60 for finishing operations to create a final printed product. Final product stack 81, in this embodiment, is a sixty-four page book because four ribbons 14 were longitudinally folded, cut into four 16-page signatures 42, 44, 46, 48 and signatures 42, 44, 46, 48 were stacked on top of one another. In alternative embodiments web 12 may be slit into a different number of ribbons and/or two or more webs can be provided to vary the number of pages in a final product produced by the present invention.

For example, assume printing press 100 includes plate cylinders 101, 104 having a printing circumference of 44" and a printing width of 68" prints images having a 44" length and a 68" width. A single web 12 slit into four 17-inch wide ribbons, which are folded longitudinally in half and cut into four 11" long signatures can deliver a 64-page, 8.5"×11" book. A second printing unit with a second slitter may be provided and a second web may be introduced. If web 12 and the second web are slit into four 17-inch wide ribbons, which are folded longitudinally in half and cut into four 11" long signatures, a 128-page, 8.5"×11" book may be created. A single web slit into six ribbons and cut into six approximately 7.33" long signatures can create a 144-page, 5.5"×7.33" book. Two webs slit into six ribbons and cut into six approximately 7.33" long signatures can create a 288-page, 5.5"×7.33" book.

Diverting assemblies 52, 54, 56, 58 and deceleration assemblies 62, 64, 66, 68 are phased so that diverting assemblies remove respective signatures 42, 44, 46, 48 from conveyor 40 in a proper orientation and arms 63 of deceleration assemblies 62, 64, 66, 68 are in proper positions to receives signatures 42, 44, 46, 48 from diverting assemblies 52, 54, 56, 58, respectively, and properly stack signatures 42, 44, 46, 48 on conveyor 60. Deceleration assemblies 62, 64, 66, 68 may driven by respective motors 91, 92, 93, 94, and diverting assemblies may be driven by respective motors. Motors 91, 92, 93, 94 may be servomotors and may be controlled by controller 200 to ensure proper phasing and allow for adjustment between the straight delivery mode and the collating mode. The motors driving diverting assemblies may also be similarly be controlled by controller 200.

In alternative embodiments, cutting assembly 30 may be configured to cut each image into a different number of signatures, or if the printing circumferences of plate cylinders 101, 104 are varied, phasing of cylinders 48, 50, 148, 150 may be varied accordingly. The number of delivery assemblies, deceleration assemblies and delivery sections may be adjusted to match the maximum number of signatures produced by cutting assembly 30. Web conversion apparatus 10 may be adjusted to accommodate three signatures from one image, for example, by deactivating diverting assembly 58 and deceleration assembly 68 and rephrasing diverting assemblies 52, 54, 56 and deceleration assemblies 62, 64, 66.

Advantageously, intermediate printed products or signatures 42, 44, 46, 48 produced by apparatus 10 may only be longitudinally folded and not half-folded or quarter-folded. Minimizing folding may reduce product defects associated with the multiple fold processes, such as fan-out, which may result from folding thicker signatures, or print-to-fold errors. Signatures may be caused to accelerate, decelerate or change directions during half-folding and quarter-folding, and thus may lead to dog-ears, z-folds or other defects in the intermediate products and limit the speed that intermediate products may be produced. Avoiding half-folding and quarter-folding also may eliminate trimming of folded edges, including the machinery, labor and waste that accompanies such operations.

Figure 4:
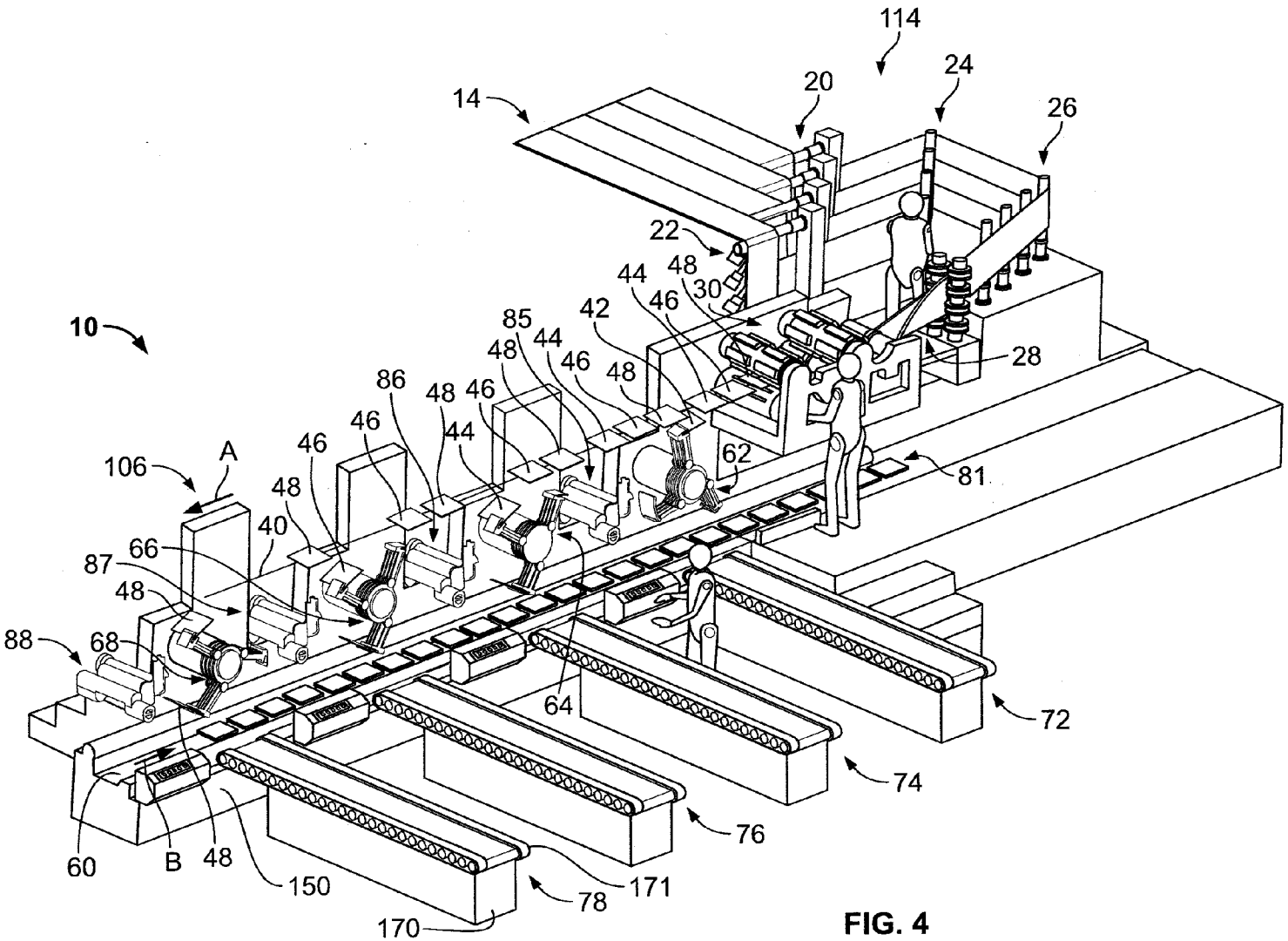
FIG. 4 shows a perspective view of the web-conversion apparatus shown in FIGS. 1 to 3 configured for collating delivery.

FIG. 4 shows a perspective view of web conversion apparatus 10 configured for collating delivery, as shown in FIG. 3. To convert from the straight delivery mode show in FIGS. 1 and 2 to collating delivery, delivery sections 72, 74, 76, 78 have been slid away from deceleration assemblies 62, 64, 66, 68 and collate conveyor 60 has been introduced. Web conversion apparatus 10 is arranged such that web conversion apparatus 10 can be switched between straight delivery, as shown in FIGS. 1 and 2, for example, and collating delivery, as shown in FIGS. 3 and 4, from print job to print job. For example, the collating conveyor may be snapped into position for the first print job of the day and then snapped out of position for the second print job of the day, while the delivery sections 72, 74, 76, 78 are slid towards the deceleration assemblies 62, 64, 66, 68, into printed product receiving positions. Conveyor 60 may also be stored within a base 150 and may be actuated to ascend from base 150 to set up web conversion apparatus 10 for collating delivery mode and descend from base 150 to set up web conversion apparatus 10 for straight delivery mode.

Delivery sections 72, 74, 76, 78 may each include a conveyor belt 171 and a base frame 170. For example, base frames 170 may be slid on rails in the floor supporting web conversion apparatus toward or away from respective deceleration assemblies 62, 64, 66, 68 or belts 171 may slide on base frames 170 or telescopically move with respect to base frames 170 such that belts 171 move toward or away from respective deceleration assemblies 62, 64, 66, 68 in and out of printed product receiving positions.

Deceleration assemblies 62, 64, 66, 68 release respective signatures 42, 44, 46, 48 to conveyor 60 to form product stacks 81. Once signature 42 is stacked upon signatures 44, 46, 48, a product stack 81 is formed. Product stack 81 is delivered by conveyor 60 for finishing operations. An in-line binder may be provided downstream of deceleration assembly 62. Product stack 81, in this embodiment, is a sixty-four page book because four ribbons 14 were longitudinally folded, cut into four signatures 42, 44, 46, 48 and signatures 42, 44, 46, 48 were stacked on top of one another. In alternative embodiments web 12 may be cut into a different number of ribbons and/or two or more webs can be provided to vary the number of pages in a final product produced by the present invention.

Hoppers 85, 86, 87, 88 may be provided before each deceleration assembly 62, 64, 66, 68, respectively, to add inserts to signatures 42, 44, 46, 48, respectively.

Figure 6:
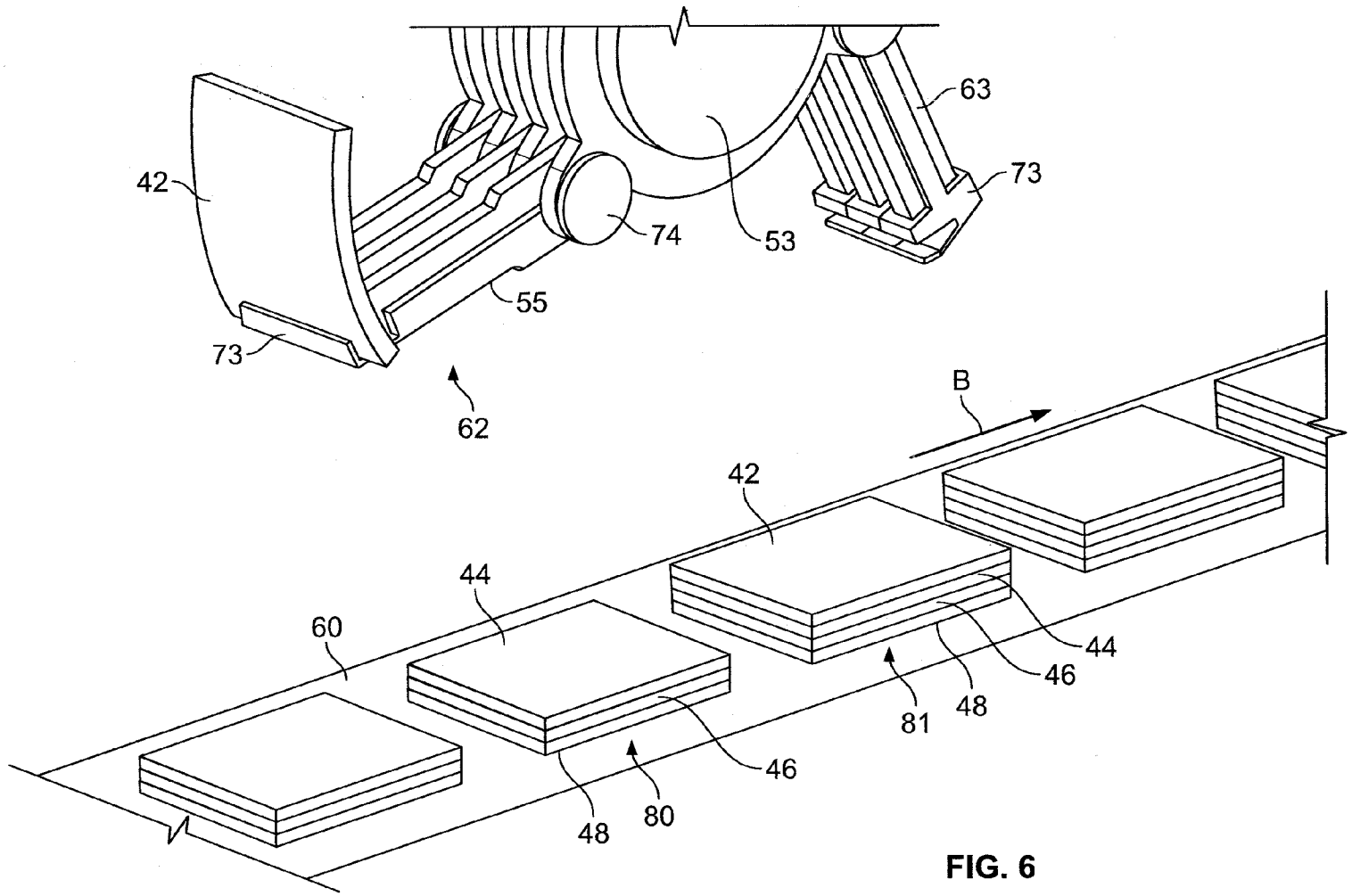
FIG. 6 shows an enlarged view of a deceleration assembly delivering signatures to a collating conveyor to form product stacks as shown in FIGS. 3 and 4.

FIG. 6 shows an enlarged view of deceleration assembly 62 shown in FIGS. 1 to 4 operating in collating delivery mode and delivering signature 42 to form product stacks 81. Deceleration assembly 62 includes center body 53, arms 63 and grippers 73. Arms 63 are connected to 53 center body 53 by connectors 55. Grippers 73 engage signatures 42 and deliver signatures 42 to conveyor 60, which is traveling in direction B. As deceleration assembly 62 is rotated about an axis of center body 53, arms 73 pass by conveyor 60 and grippers 73 release signatures 42 on top of partial product stack 80.

Each partial product stack 80 includes signature 48 resting on conveyor 60, signature 46 stacked upon signature 48 and signature 44 stacked upon signature 46. Once signature 42 is stacked upon signature 44, product stack 81 is formed. Deceleration assemblies 64, 66, 68 are configured similar to deceleration assembly 62 and transport signatures in a manner similar to how deceleration assembly 62 transports signatures 42.

Figure 7:
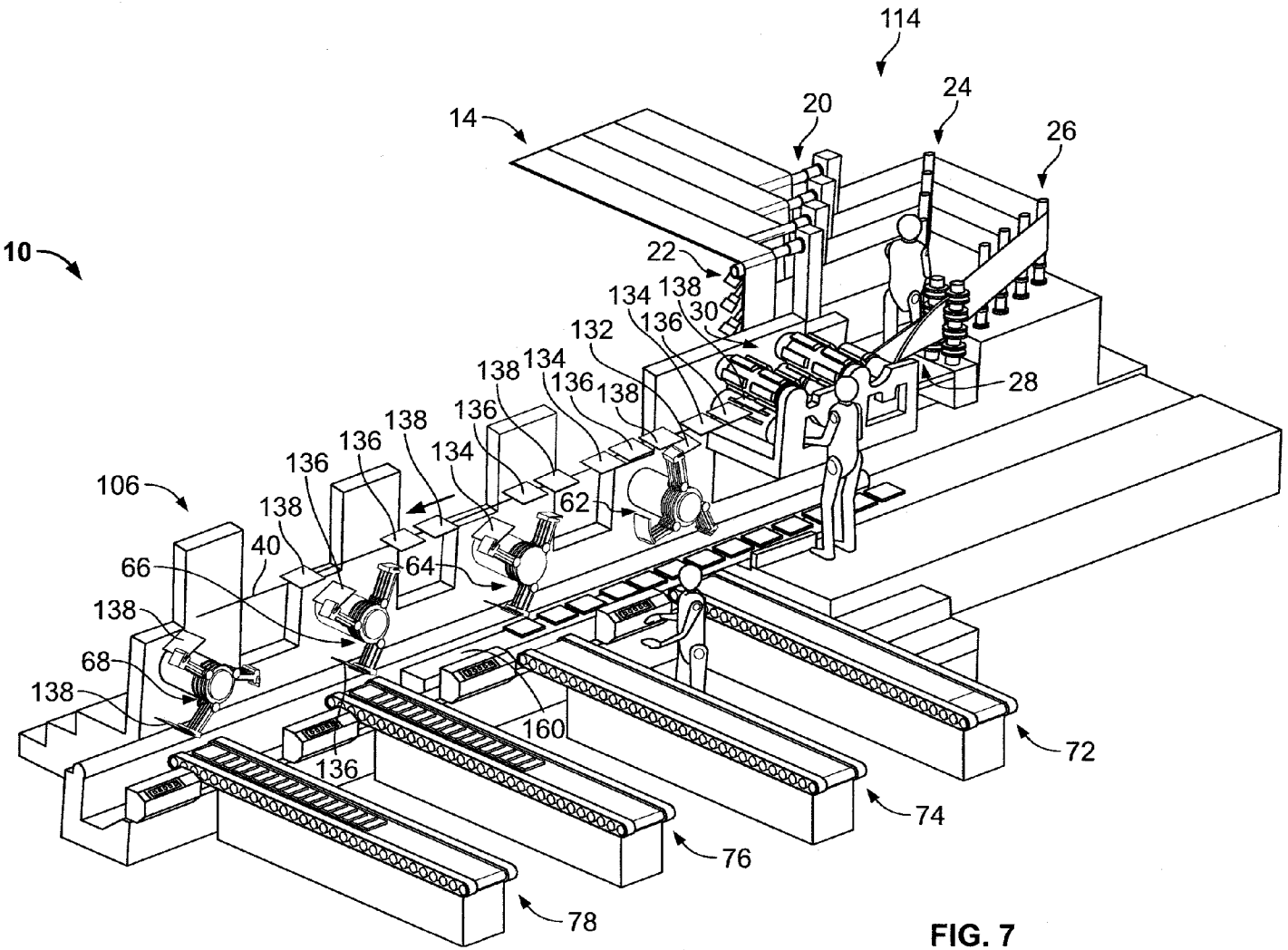
FIG. 7 shows a perspective view of the web-conversion apparatus shown in FIGS. 1 to 4 configured to run for both straight delivery and collating delivery simultaneously.

FIG. 7 shows a perspective view of web-conversion apparatus 10 shown in FIGS. 1 to 4 configured to run for both straight delivery and collating delivery simultaneously. Delivery sections 76, 78 are slid under deceleration assemblies 66, 68 in position for straight delivery of signatures 136, 138. Delivery sections 72, 74 are slid away from deceleration assemblies 62, 64 so that a collating conveyor 160 can be included in web-conversion apparatus 10 for collating delivery of signatures 132, 134. Collating conveyor 160 may be a second conveyor snapped into place below deceleration assemblies 63, 64. In an alternative embodiment, collating conveyor 60 (FIGS. 3, 4) may be caused to partially ascend from base 150 so that collating conveyor 60 may receive signatures 132, 134, but does not receive signatures 136, 138 and does not interfere with the operation of delivery sections 72, 74.

Ribbons 14, guided and offset by web guiding assembly 114 and longitudinally folded by former section 28, are cut by cutting assembly 30 into successive signatures 132, 134, 136, 138. Signatures 132, 134 are the same length, while signatures 136, 138 may be different lengths. Signatures 132, 134, 136, 138 may also all be the same length, for example 11 inches. Cutting assembly 30 is phased and configured according the desired lengths of signatures 132, 134, 136, 138. Signatures 132, 134, 136, 138 are transported away from cutting assembly 30 by transport conveyor 40.

Diverter assembly 52 (FIG. 1) removes signatures 132 from conveyor 40 and transports signatures 132 to a first deceleration assembly 62. Signatures 134 are transported by conveyor 40 past first diverter assembly 52 (FIG. 1) and to a second diverter assembly 54 (FIG. 1), which removes signatures 134 from conveyor 40 and transports signatures 134 to a second deceleration assembly 64.

Second deceleration assembly 64, receives each signature 132 one-by-one and passes signatures 132 to a collating conveyor 160. Collating conveyor 160 is traveling in the second horizontal plane below the horizontal plane of conveyor 40. Collating conveyor 160, in this embodiment, is traveling below deceleration assemblies 62, 64, in a horizontal direction that is opposite the horizontal direction that conveyor 40 transports signatures 132, 134, 136, 138, and is tangential to the paths of rotation of deceleration assemblies 62, 64. First deceleration assembly 62, operating in a manner similar to second deceleration assembly 64, receives signatures 132 and places one signature 132 on top of each signature 134 transported by conveyor 160.

Signatures 136, 138 are transported by conveyor 40 past diverter assemblies 52, 54 (FIG. 1). A third diverter assembly 56 (FIG. 1) removes signatures 136 from conveyor 40 and transports signatures 136 to third deceleration assembly 66. Third deceleration assembly 66, rotating about a third axis, grips signatures 136 and delivers signatures 136 to third delivery section 76. Third delivery section 76, carries signatures 136 away from deceleration assembly 66 for finishing operations.

Signatures 138 are transported by conveyor 40 past third diverter assembly 56 (FIG. 1). A fourth diverter assembly 58 (FIG. 1) removes signatures 138 from conveyor 40 and transports signatures 138 to fourth deceleration assembly 68. Fourth deceleration assembly 68, grips signatures 138 and delivers signatures 138 to fourth delivery section 78. Fourth delivery section 78, carries signatures 138 away from deceleration assembly 68 for finishing operations.

The number of deceleration assemblies may be varied so that a number of different embodiments of the present invention are possible. For example, a web conversion apparatus including six deceleration assemblies may have all six deceleration assemblies involved in straight delivery of six signatures or collating delivery of one product stack. Also, for example, two deceleration assemblies may be involved in collating delivery of one product stack, two deceleration assemblies may be involved in collating delivery of another product stack and two deceleration assemblies may be involved in straight delivery of respective signatures.

A number of mechanisms may be utilized to move the delivery sections/conveyors in and out of delivery position. For example, fully manual reconfigurations may be employed with operators disassembling the delivery sections/conveyors and moving components from position to position. Also, for example, various degrees of automation are possible. The delivery sections/conveyors could be fully automated whereas the delivery sections/conveyors could be reconfigured at the push of a button, or in response to control system commands.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A cutting assembly for receiving ribbons from a variable cutoff printing unit, the cutting assembly comprising:

a cutting device cutting the ribbons to separate the longitudinal sections into a plurality of signatures, the cutting device including at least one cut cylinder and at least one anvil cylinder, the cutting device including at least one servomotor;

at least one guide guiding the ribbons and the signatures horizontally as the ribbons are cut by the cutting device into a plurality of signatures; and a controller, the controller connected to the servomotor, the controller driving the servomotor at varying velocities during each revolution;

wherein the at least one guide includes guide belts.

2. The cutting assembly recited in claim 1, wherein the at least one cut cylinder includes a first cut cylinder and a second cut cylinder, at least one anvil cylinder including a first anvil cylinder interacting with the first cut cylinder and a second anvil cylinder interacting with the second cut cylinder, and the at least one servomotor includes a first servomotor and a second servomotor, the first servomotor driving the first cut cylinder and first anvil cylinder at varying velocities during each revolution, the second servomotor driving the second cut cylinder and second anvil cylinder at varying velocities during each revolution.

3. The cutting assembly recited in claim 1, wherein the variable cutoff printing unit is configurable to print a first print job and a second print job, and the controller increases or decreases the average rotational velocity of the cutting assembly between the first and second print jobs.

4. The cutting assembly recited in claim 2, wherein the variable cutoff printing unit is configurable to print a first print job and a second print job, and the controller increases or decreases the average rotational velocity of the cutting assembly between the first and second print jobs.

5. A cutting and processing arrangement, comprising:

the cutting assembly of claim 1; and a decelerating assembly downstream of the cutting device orienting the signatures on top of each other.

6. The cutting and processing arrangement recited in claim 5, further comprising at least one further servo motor connected to the decelerating assembly, the controller controlling the at least further one servo motor.

7. The cutting and processing arrangement recited in claim 5, wherein the signatures are stacked directly on top of each other.

8. The cutting assembly recited in claim 1, further comprising a conveyor receiving the signatures.

9. The cutting assembly recited in claim 8, wherein the conveyor is traveling at a velocity slower than the ribbons as the ribbons are cut into the signatures.

* * * * *